US006164824A

United States Patent [19]

McGlew et al.

[11] Patent Number: 6,164,824

[45] Date of Patent: *Dec. 26, 2000

[54] GARBAGE BAG WITH ELASTIC RIM EDGE SUPPORT

[76] Inventors: John James McGlew, 653 Scarborough Rd., Briarcliff Manor, N.Y. 10510; Henry Lansing McVickar, III, 260 Piermont Ave. S., Nyack, N.Y. 10960

[ * ] Notice: Under 35 U.S.C. 154(b), the term of this patent shall be extended for 225 days.

[21] Appl. No.: 08/713,788

[22] Filed: Sep. 13, 1996

[51] Int. Cl.[7] ..... B65D 33/28

[52] U.S. Cl. ..... 383/75; 383/43

[58] Field of Search ..... 383/43, 75; 220/404

[56] References Cited

U.S. PATENT DOCUMENTS

| | | | |
|---|---|---|---|
| 2,241,309 | 5/1941 | Kovalik | 383/43 |
| 2,585,214 | 2/1952 | Belmont | 383/43 |
| 5,133,607 | 7/1992 | Bonke | 220/404 |
| 5,232,118 | 8/1993 | Samuel | 383/75 |

*Primary Examiner*—Stephen P. Garbe
*Attorney, Agent, or Firm*—McGlew & Tuttle

[57] ABSTRACT

A garbage bag is provided with a top edge folded over defining a top edge loop space. An elastic element or an element which has at least a partial length of elastic material is provided in the loop space.

12 Claims, 8 Drawing Sheets

GARBAGE BAG WITH ELASTIC RIM EDGE SUPPORT

FIELD OF THE INVENTION

The present invention relates to the field of garbage bags or trash bags in general and more particularly to garbage/trash bags which have a cinch or tie provided for closing the bag after filling.

BACKGROUND OF THE INVENTION

Garbage bags have been increasingly used for household garbage removal. In some locations, garbage is not picked up unless the garbage is properly presented for removal.

The task of removing the garbage from the household has also been made easier by the provision of garbage bags with closures which are easy to use.

Early trash bags were often sold with twist-ties for closing the trash/garbage bag after it is filled with trash/garbage. Although these were very useful for closing the bag, these were sometimes difficult to manipulate. Various other types of ties have been used including ties which are already attached to the bag.

Bags have now been made to provide a contour or shape at the top of the bag providing tie ends for closure of the top of the bag. Additionally, bags have been made with cinches provided attached to the bag including cinches which are provided within the bag structure. Particularly, bags have been formed with ends which are folded over to form a bag loop space which a cinch may be looped through. In operation, after the bag is filled with trash and garbage, the cinch is pulled and the bag is closed.

SUMMARY AND OBJECTS OF THE INVENTION

Although the problems relating to the closure of garbage bags has been significantly alleviated by the use of bags with shaped ends for tieing or cinch elements provided within the bag, these closure solutions do not provide any help with another bag problem, namely the slippage of a garbage bag down into a trash basket or can as the plastic container is being filled. Specifically, most plastic garbage bags are filled by first positioning them within a trash basket or trash can (such as a kitchen garbage can). However, during the process of filling such bags, the bag will often go into the garbage can (with the top of the bag being mixed in with the garbage and potentially garbage being thrown outside of the bag), not just within the bag.

It is an object of the invention to provide a trash bag which preferably is easy to close for removal of the trash and garbage and for the containment of the trash and garbage within the trash bag but which also has an effective means for keeping the top end of the trash bag in position relative to a trash can, namely not allowing slippage of the top end of the trash bag relative to the trash can.

According to the invention, a garbage bag is provided with a top edge folded over or otherwise provided to define a top edge loop space. An elastic element or an element which has at least a partial length of elastic material is provided in the loop space.

According to one embodiment of the invention, an elastic band element is disposed just inwardly of an upper edge of a plastic bag. The upper edge is then folded around the rubber band and the upper edge of the bag is welded such that the elastic band is retained in the loop space defined by the folded over upper edge of the plastic bag.

According to another embodiment of the invention, the first embodiment of the invention is provided along with an additional element provided in a loop, at least partially in the loop space. This may be a plastic cinch loop, specifically a plastic element provided in a ring shape in the loop space. An opening is provided from outside of the bag into the loop space for access to the plastic cinch element (to pull a part of it out of the loop space for tightening). According to a further variant of the invention, the additional loop element, the loop of plastic, may be disposed in a separate loop space.

According to a third embodiment of the invention, an elastic portion is connected to a plastic cinch element to form a combined elastic element/cinch element. The plastic element may be provided on one or more side(s) of the elastic element or even surround/encase the elastic element to reduce friction upon relative movement of the bag, the elastic element and the plastic element. This combined element is disposed in the loop space defined by the folded over upper edge of the plastic bag. The loop space again preferably has an access opening to the outside of the bag for access to the plastic portion or cinch portion of the combined element.

Various different materials can be used for the elastic element and for the cinch element. Examples of materials for the cinch element include extruded plastic or plastic film and other materials including heat sealable plastics such as those used for plastic bags and cinch tie strips. Materials for the elastic element include ordinary rubber band material and other synthetic and natural rubber type elastic materials. Further, the elastic structure may be an elastic element or elastic elements provided with fabric. This combined structure may be such as those used in the apparel industry—apparel elastic. Further, the elastic element may be formed with fabric or waste lint, cellulose or other material provided on its outer surface. This material may also be applied with adhesive or by electrostatic or other means. The material to be combined with the elastic element or elements preferably enhances the strength/elongation characteristics of the elastic loop element (to ensure good support of the bag end relative to the trash/garbage can), and/or reduces friction relative to the bag and/or provides at least a portion which is graspable by the user, for cinching or tying the bag end.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
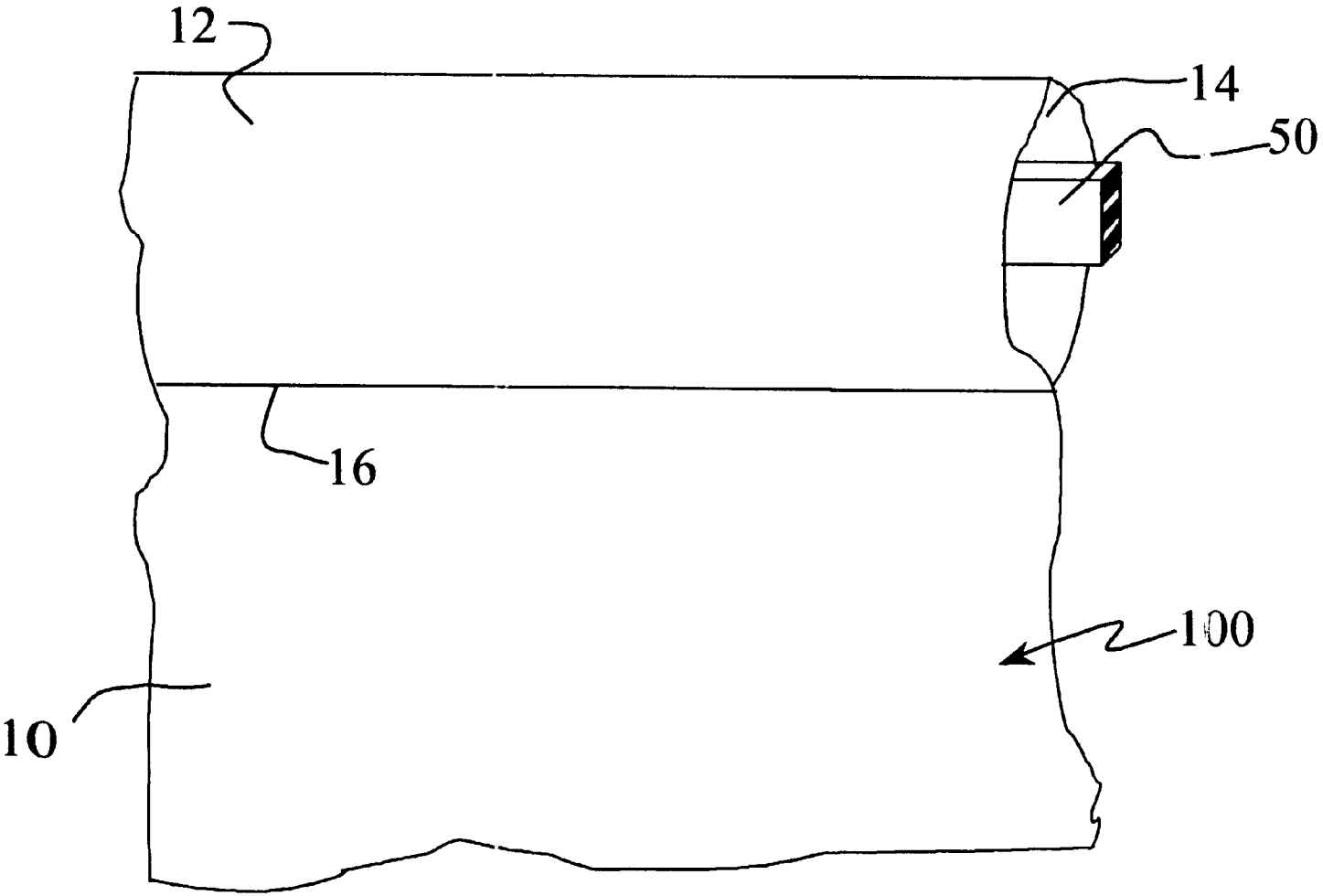
FIG. 1 is a cross-sectional view showing the construction of the bag with the loop space and elastic or partially elastic element of an embodiment of the invention.

Referring to the drawings in particular, the invention comprises a trash bag generally designated 100. The bag 100 is formed of a plastic material 10. The plastic material 10 is folded over at an upper edge 12 to form a loop space 14. Specifically, adjacent to the upper edge 12, a weld seam 16 is formed which bonds the upper edge 12 to another portion of the plastic material 10 to provide the loop space 14. An opening 17 may be provided in the bag (see FIGS. 2, 3 and 4) to provide access from outside of the bag to the interior of the loop space 14.

An at least partially elastic element 50 is provided in the loop space 14. Preferably, the elastic element 50 is a continuous ring shaped member which provides a rest diameter RD of the elastic element 50, in a rest position which is very small as compared to a stretched diameter SD of the partially elastic element 50.

In operation, the bag is removed from a box or container and is placed within a garbage can such as a plastic kitchen garbage can 200. The upper end 12 of the bag 100 is pulled over the outer part of the kitchen garbage bag by grasping the inside of the upper end of the garbage bag to pull the elastic element from its smallest diameter to a larger diameter and to allow the upper edge of the garbage bag to be stretched over the outer rim of the garbage can. The elastic element attempts to resume its smallest size RD and fixes the upper end of the garbage bag to the garbage can (see FIG. 11).

The materials for the elastic element is ordinary rubber band material and other synthetic and natural rubber type elastic materials. Further, the elastic structure may be an elastic element or elastic elements provided with fabric. This combined structure may be optimized to provide the strength/elongation characteristics of the elastic loop element (to ensure good support of the bag end relative to the trash/garbage can), reduce friction relative to the bag and provide at least a portion which is graspable by the user, for cinching or tying the bag end.

The combined structure may be elastic structures such as those used in the apparel industry. Further, the elastic element may be formed with fabric or waste lint, cellulose or other material provided on its outer surface. These material may also be applied with adhesive or by electrostatic or other means.

Figure 4:
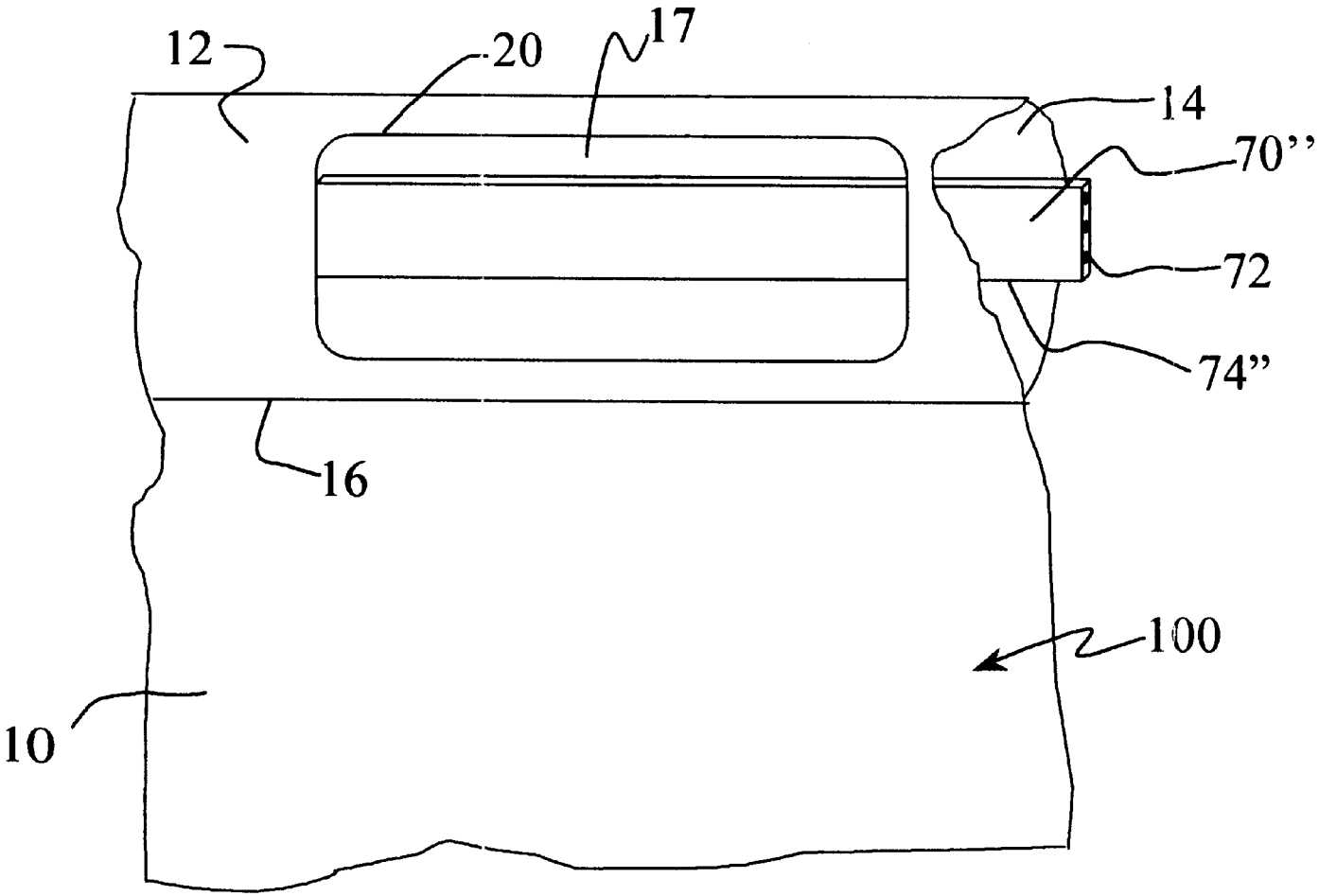
FIG. 4 is a cross-sectional view showing the construction of the bag with the loop space and elastic or partially elastic element of another embodiment of the invention.
Figure 5:
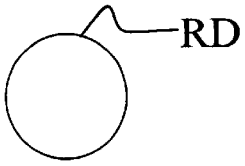
FIG. 5 is a top view of an elastic element with a large elongation strength, shown in a rest state and disposed in the loop space of a trash bag.
Figure 6:
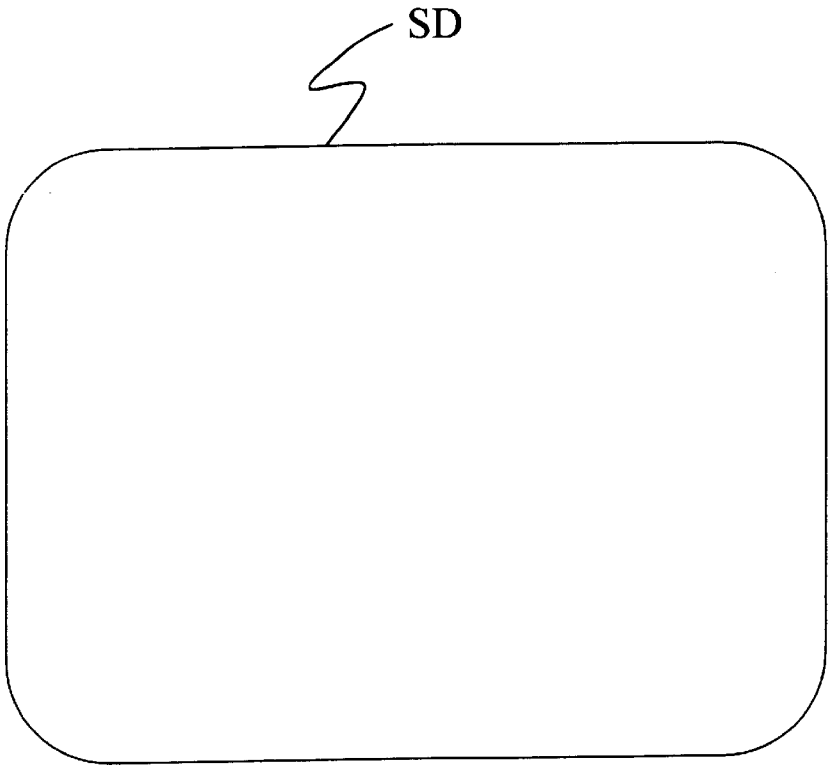
FIG. 6 is a top view of the elastic element of FIG. 5 shown in an elongated state engaging the garbage can.
Figure 7:
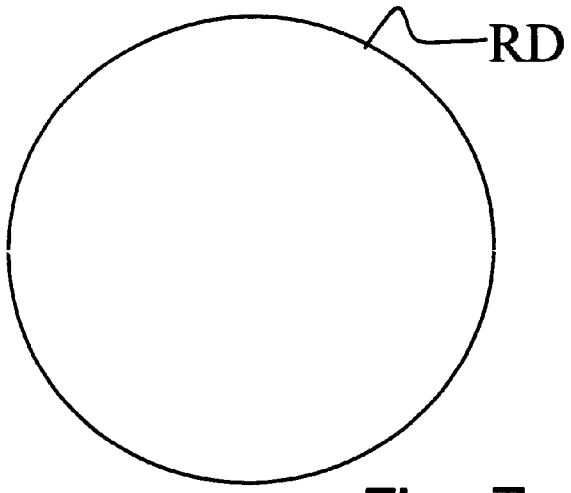
FIG. 7 is a top view of an elastic element with a less elongation strength and or a larger rest diameter and also a fabric/plastic component, shown in a rest state installed in the loop space of a trash bag, providing slack for grasping to cinch or tie.
Figure 8:
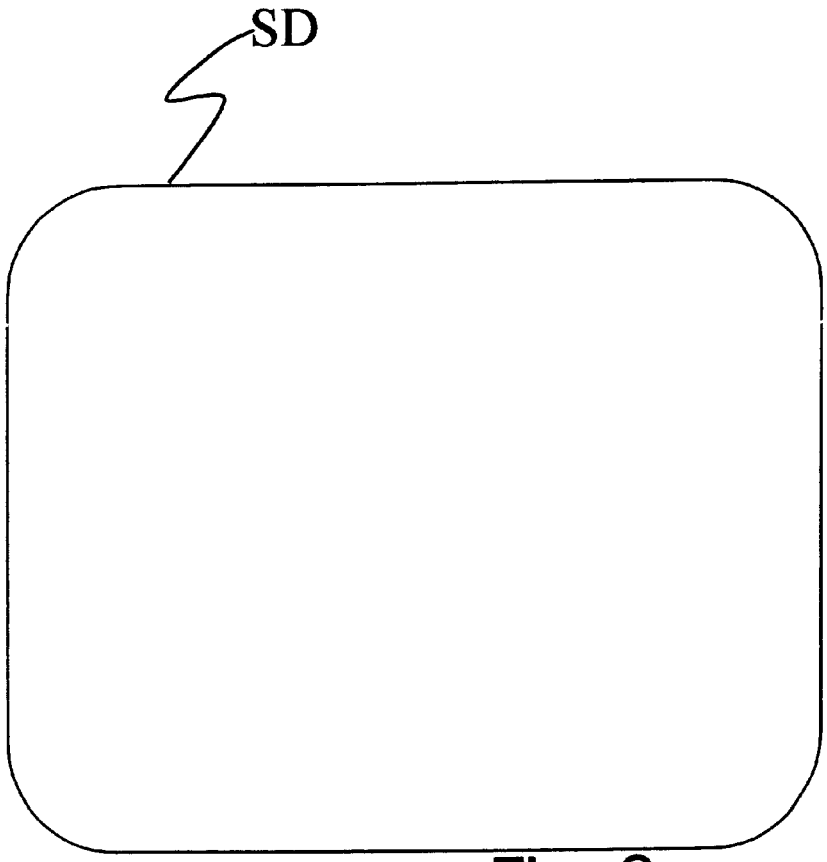
FIG. 8 is a top view of the elastic element of FIG. 7 shown in an elongated state engaging the garbage can.

The bag may have a very small rest state relative to an engaged state as shown in FIGS. 5 and 6 (the rest state when the band is fully or partially in the loop space) providing a small rest diameter RD. This effectively closes the bag end. The bag may have a larger rest state as shown in FIGS. 7 and 8 (the rest state when the band is fully or partially in the loop space) providing a larger rest diameter RD. The larger rest diameter does not effectively close the bag but the element (a slack or graspable part) may be grasped for typing or cinching (see also FIG. 4).

Figure 2:
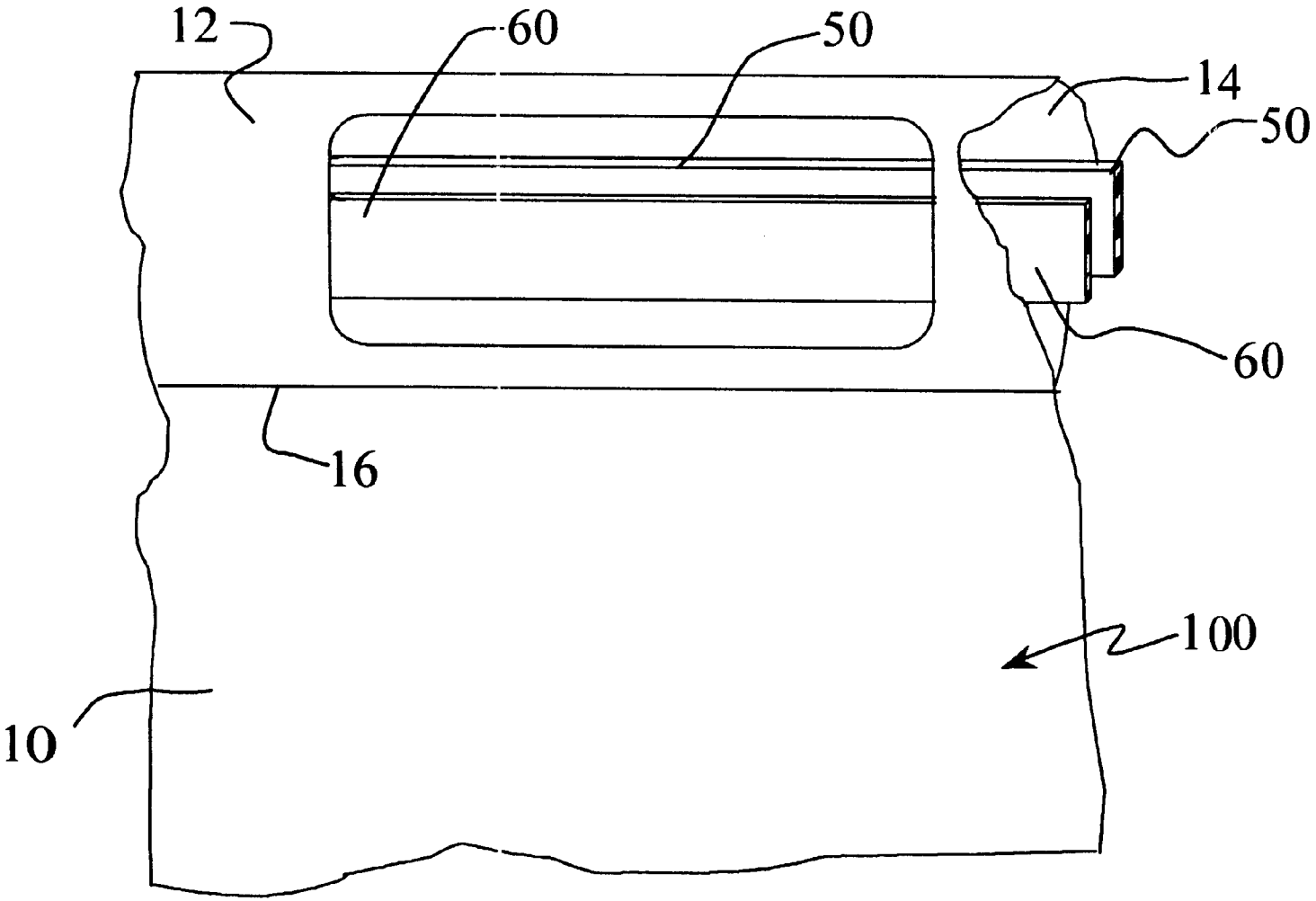
FIG. 2 is a cross-sectional view showing the construction of the bag with the loop space and elastic or partially elastic element of another embodiment of the invention.
Figure 3:
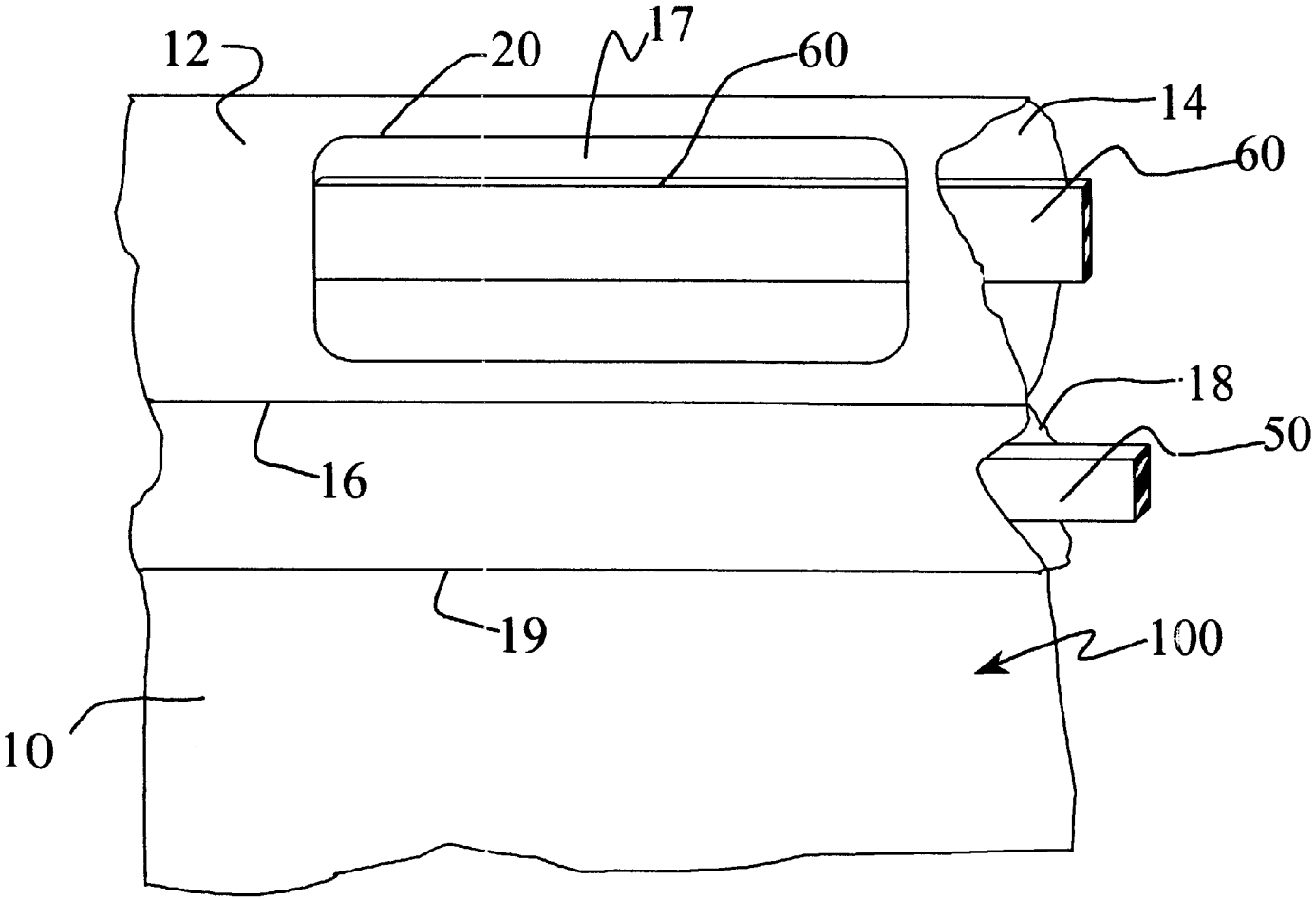
FIG. 3 is a cross-sectional view showing the construction of the bag with the loop space and elastic or partially elastic element of another embodiment of the invention.

Referring to FIG. 2, a garbage bag 12, which is substantially the same as the garbage bag shown in FIG. 1 is used. However, in addition to the elastic element 50, there is also provided a plastic cinch element 60. The plastic cinch element 60 is also made in a loop however the diameter of the plastic element is greater than an extended diameter of the elastic element 50. It is noted that the cinch element can also be provided in a different loop portion or additional loop space 18, by providing an additional weld 19, to form two loop spaces (this is shown in FIG. 3).

In operation, the cinch element 60 may be extended out of the opening 20. However, first the bag 12 is moved from the box or container and is disposed in a kitchen garbage can and the upper end of the bag 12 is again disposed about the rim of the garbage can 200, as noted with the first embodiment. With the first embodiment, when the bag is removed, the elastic element closes to its smallest diameter. However, in the second embodiment, in addition, the cinch element extending out of the hole 20 may be used to tie the top end or wrap the top end of the garbage bag to prevent odors or material from escaping from the garbage bag.

According to another embodiment as shown in FIG. 4, a combined element 70" is formed of elastic strands 72 and another component 74" such as fabric or waste lint cellulose etc. Apparel elastic may be used. The rest state of the combined element is preferably similar to that shown in FIG. 7, to provide a slack graspable portion.

Figure 9:
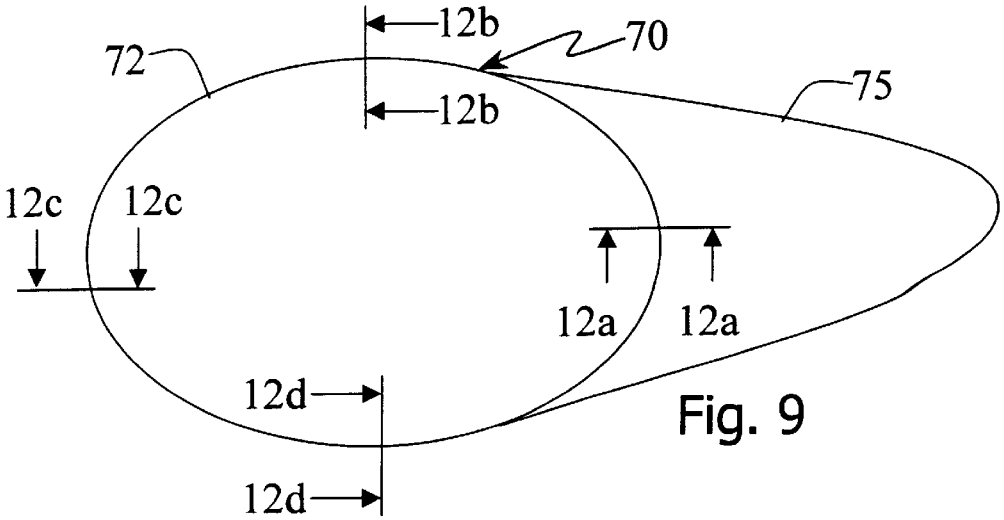
FIG. 9 is a top view of an elastic element with a plastic portion forming a cinch/tie portion.

According to another embodiment of the invention, the same bag 100 is used as in the case of the first embodiment of the invention. However, the elastic element 50 is replaced by an element 70 as shown in FIG. 9. The elastic element includes a small elastic ring portion 72 and a non-elastic portion 74. The non elastic portion 74 includes a ring or loop which encloses the elastic portion 72, or covers one or more of the sides. The non-elastic portion 74 includes a non-elastic extension 75.

Figure 10:
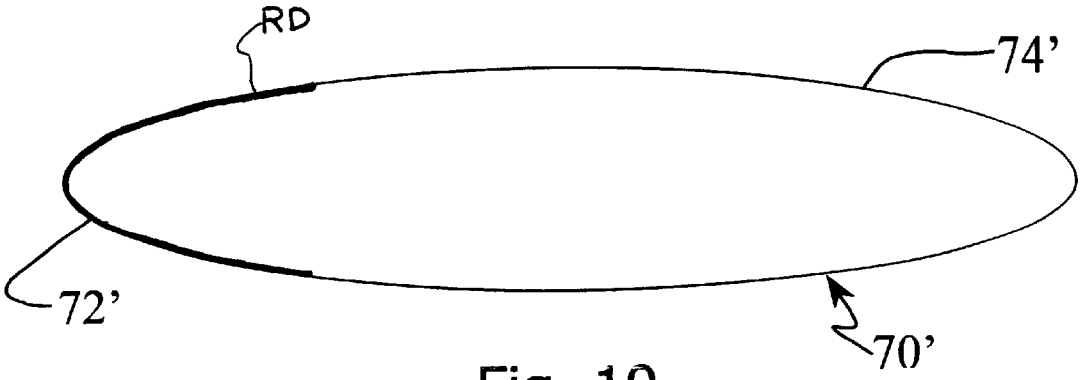
FIG. 10 is a top view of another elastic element with a plastic portion forming a cinch/tie portion.

A variant of the combined structure is shown in FIG. 10. The non-elastic portion 72' and the elastic portion 74' together provide an element 70' with a diameter in a rest state of the elastic portion which is somewhat smaller than the typical trash can. In this way, there is allowed a stretching of the elastic portion for allowing the top end of the garbage can to be fixed about a rim of the garbage can 200. However, the combined element 70 can also be pulled by the non-elastic portion for tieing up the top end of the bag or wrapping the top end, in a manner similar to the manner used for the second embodiment of the invention.

Figure 11:
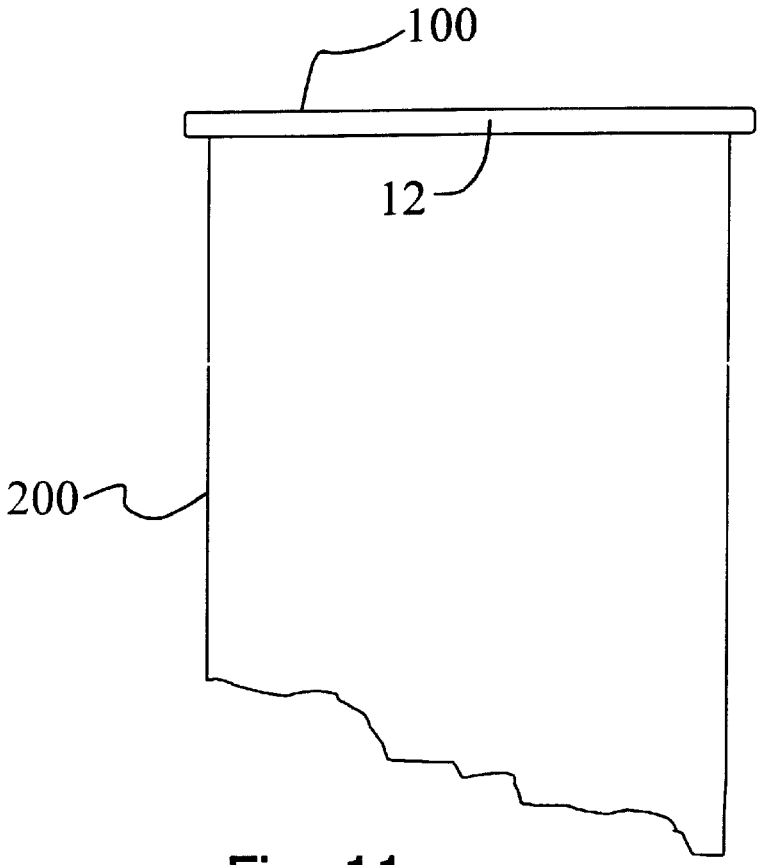
FIG. 11 is a side view of the garbage bag of the invention with its top end pulled over the top edge of a garbage can, with the bag top edge engaging the outside of the garbage can.
Figure 12A:
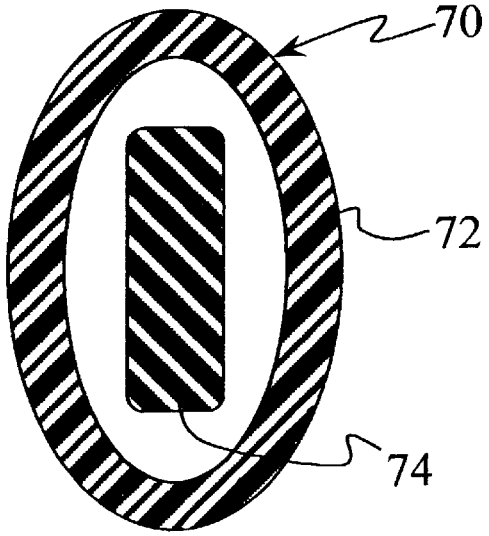
FIG. 12*a* is a cross-sectional view taken in the direction of line 12*a*—12*a* of FIG. 9.
Figure 12B:
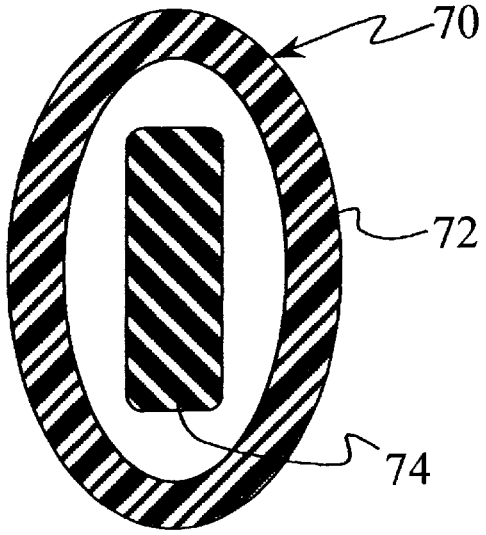
FIG. 12*b* is a cross-sectional view taken in the direction of line 12*b*—12*b* of FIG. 9.
Figure 12C:
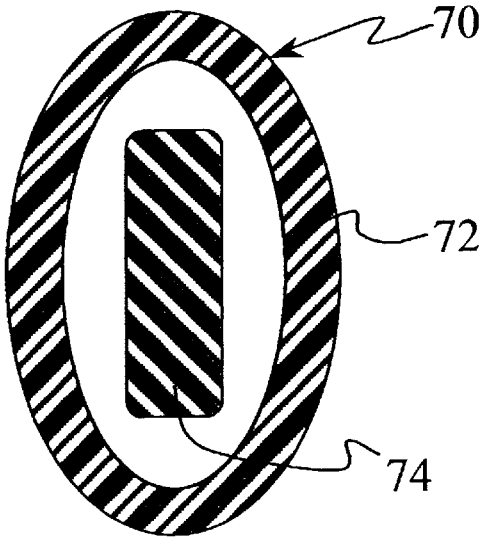
FIG. 12*c* is a cross-sectional view taken in the direction of line 12*c*—12*c* of FIG. 9.
Figure 12D:
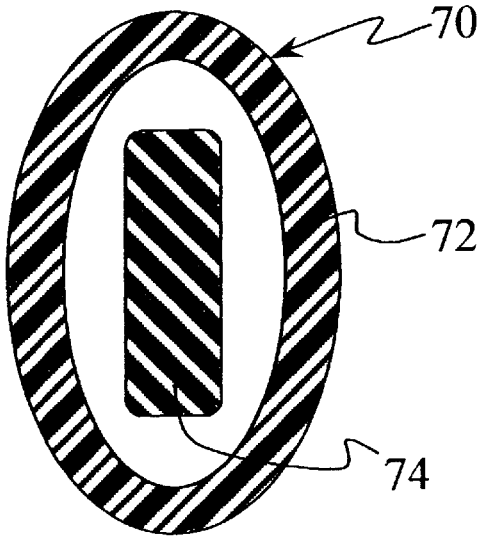
FIG. 12*d* is a cross-sectional view taken in the direction of line 12*d*—12*d* of FIG. 9.

As shown in FIG. 11, the bag 100 top edge 12 (of each embodiment of the invention) is pulled over the top edge of a garbage can 200. The top edge 12 engages the outside of the garbage can, preferably just under the top edge or rim. This effectively holds the top edge 12 of the bag 100 substantially fixed the can 200. After filling, the bag 100 is removed by stretching the top edge 12 (and the elastic portion in the loop space) to remove the bag. The top edge of the bag is closed as described above (either by return of the elastic to the rest diameter or by tieing or cinching.

While specific embodiments of the invention have been shown and described in detail to illustrate the application of the principles of the invention, it will be understood that the invention may be embodied otherwise without departing from such principles.

What is claimed is:

1. A garbage bag, comprising:

a top end defining a loop space; and a loop element disposed in said loop space, said loop element being substantially ring shaped and including at least an elastic portion for maintaining said loop at a first diameter whereby said loop may be stretched to a second diameter which is greater than said first diameter, said elastic portion includes an elastic element forming a ring and fibrous material connected to said elastic element, surrounding said elastic element, said fibrous material being disposed between said elastic element and said garbage bag forming said loop space.

2. A garbage bag according to claim 1, wherein said loop space is defined by a top edge of said bag folded over and welded to a side of said bag.

3. A garbage bag according to claim 1, wherein said loop element comprises an elastic portion and a plastic portion.

4. A garbage bag according to claim 3, wherein said elastic portion is an elastic ring and said plastic portion surrounds at least a portion of said ring, said plastic portion being formed of a material selected to stretch upon a stretching of said elastic portion.

5. A garbage bag, comprising:

a top end defining a loop space; and a loop element disposed in said loop space, said loop element being substantially ring shaped and including at least an elastic portion and a plastic portion, said elastic portion for maintaining said loop at a first diameter whereby said loop may be stretched to a second diameter which is greater than said first diameter wherein said elastic portion is elastically deformable and said plastic portion is plastically deformable.

6. A garbage bag according to claim 5, further comprising fibrous material connected to said elastic portion, said fibrous material surrounding said elastic portion, said fibrous material being disposed between said elastic portion and said garbage bag forming said loop space.

7. A garbage bag according to claim 5, wherein said loop space is defined by a top edge of said bag folded over and welded to a side of said bag.

8. A garbage bag according to claim 5, wherein said elastic portion comprises apparel elastic.

9. A garbage bag, comprising:

a top end defining a loop space; and a loop element disposed in said loop space, said loop element being substantially ring shaped and including at least an elastic portion having a first diameter and a plastic portion, said loop being stretchable to a second diameter which is greater than said first diameter, said elastic portion including an elastic ring and said plastic portion surrounding at least a portion of said ring, said plastic portion being formed of a material selected to stretch upon a stretching of said elastic portion wherein said elastic portion is elastically deformable and said plastic portion is plastically deformable, said plastic portion including a non elastic loop extension.

10. A garbage bag according to claim 9, further comprising fibrous material connected to said elastic portion, said fibrous material surrounding said elastic portion, said fibrous material being disposed between said elastic portion and said garbage bag forming said loop space.

11. A garbage bag according to claim 9, wherein said loop space is defined by a top edge of said bag folded over and welded to a side of said bag.

12. A garbage bag according to claim 9, wherein said elastic portion comprises apparel elastic.

* * * * *